United States Patent [19]

Takegawa

[11] Patent Number: 4,732,179

[45] Date of Patent: Mar. 22, 1988

[54] AUTOMATIC PICKING CONDITIONS REGULATING METHOD AND A DEVICE FOR CARRYING OUT THE SAME

[75] Inventor: Yujiro Takegawa, Ishikawa, Japan

[73] Assignee: Tsudakoma Corp., Kanazawa, Japan

[21] Appl. No.: 939,319

[22] Filed: Dec. 8, 1986

[30] Foreign Application Priority Data

Feb. 24, 1986 [JP] Japan ..... 61-39653
Sep. 18, 1986 [JP] Japan ..... 61-221225

[51] Int. Cl.[4] ..... D03D 47/36

[52] U.S. Cl. ..... 139/435; 139/452; 139/116

[58] Field of Search ..... 139/116, 429, 435, 452

[56] References Cited

U.S. PATENT DOCUMENTS 4,487,235 12/1984 Sugita .
4,595,039 6/1986 Tholander .
4,607,668 8/1986 Tholander .
4,658,865 4/1987 Gotoh ..... 139/435

FOREIGN PATENT DOCUMENTS 164773 12/1985 European Pat. Off. ..... 139/435
56-96938 8/1981 Japan .
56-107046 8/1981 Japan .

*Primary Examiner*—Henry S. Jaudon
*Attorney, Agent, or Firm*—Flynn, Thiel, Boutell & Tanis

[57] ABSTRACT

An automatic picking conditions regulating device regulates the picking conditions of one of the same of a picking device having a picking nozzle which picks a weft yarn by jetting a pressurized picking fluid, in order to pick a weft yarn so that the same arrives at a predetermined position at a target weft yarn arrival crankshaft angle. When the weaving conditions of the loom are changed, a picking condition, such as the pressure of the picking fluid or the jet starting crankshaft angle, is varied sequentially, the corresponding actual weft yarn arrival crankshaft angles are measured, and then the values of the controlled picking condition and the measured actual weft yarn arrival crankshaft angles are used to determine an optimum value of the picking condition for making the actual weft yarn arrival crankshaft angle coincide with the target weft yarn arrival crankshaft angle. A series of the picking condition regulating operations are carried out during the trial picking operation and/or during the normal weaving operation of the loom.

13 Claims, 5 Drawing Figures

AUTOMATIC PICKING CONDITIONS REGULATING METHOD AND A DEVICE FOR CARRYING OUT THE SAME

BACKGROUND OF THE INVENTION

1. Field of the Invention

The present invention relates to a picking device for a fluid jet loom and, more particularly, to an automatic picking conditions regulating method and a device for carrying out the same for adjusting the weft yarn arrival crankshaft angle at the start and during the weaving operation of the loom.

2. Prior Art

It has been the conventional procedure of adjusting the weft yarn arrival crankshaft angle, when the weaving conditions are changed, to observe the traveling conditions of the weft yarn by means of a stroboscopic method or to measure the moment of arrival with a weft yarn arrival detector during the weaving operation, to display the measured results digitally, and to adjust the picking nozzle manually. Such a conventional procedure requires a long time and is unable to adjust the weft yarn arrival crankshaft angle properly and to adjust a plurality of looms in the same picking conditions. Accordingly, the looms are unable to operate at high efficiency and to weave high-quality woven fabrics.

Japanese Patent Laid-open Publication Nos. 56-96,938 and 56-107,046 (which respectively corresponds to U.S. Pat. Nos. 4,446,893 and 4,458,726) disclose inventions for adjusting the weft yarn arrival crankshaft angle to a target crankshaft angle by varying the picking fluid pressure or the rotating speed of the crankshaft. These inventions, however, are intended to adjust the weft yarn arrival crankshaft angle while the loom is operating. Accordingly, when the weaving conditions are changed, the picking conditions including the picking fluid pressure are set at the initial stage of the weaving operation on the basis of the previous experimental data or the result of measurement by the stroboscopic method.

According to the foregoing prior inventions, the weft yarn arrival crankshaft angle is adjusted through automatic control procedure after the loom has been started regardless of the value, provided that the controllable range is wide. However, when the control range is wide, the condition of control becomes transiently unstable during the process of control and, since the deviation of the crankshaft angle increases in the weaving operation after the adjustment of the crankshaft angle, the rapid and accurate regulation of the weft yarn arrival crankshaft angle within a target range is difficult.

SUMMARY OF THE INVENTION

Accordingly, it is an object of the present invention to provide an automatic picking conditions regulating method and a device for carrying out the same capable of automatically setting picking conditions at the initial stage of operation of the loom so that the actual weft yarn arrival crankshaft angle coincides with a target weft yarn arrival crankshaft angle, and capable of rapidly dealing with the change of weaving conditions of a plurality of looms for multi-product small-scale production to stabilize the quality of woven fabrics through the stabilization of picking operation after the adjustment of the weft yarn arrival crankshaft angle.

According to the present invention, during a trial picking operation after the loom has been set for new weaving conditions or after the weaving conditions have been changed, various picking modes are tried sequentially, actual weft yarn arrival crankshaft angles corresponding to the various picking modes are measured, the data of the picking modes and the corresponding actual weft yarn arrival crankshaft angles are stored in a memory, and appropriate picking conditions for realizing the target weft yarn arrival crankshaft angle are calculated on the basis of the stored data. During the weaving operation after the determination of the picking conditions, the picking device operates according to the thus determined picking conditions.

Although the principal one of the picking conditions is the pressure of the picking fluid, the object of regulation of the picking conditions may be the picking fluid jetting start timing and a picking fluid jetting end timing, or the combination of those conditions, namely, the pressure of the picking fluid, the picking fluid jetting start timing and the picking fluid jetting end timing.

The method and device according to the present invention are applied also to a multiple weft loom. When applied to such a loom, the device identifies the picking mode and the corresponding weft yarn arrival crankshaft angle for each type of weft yarn and stores the data individually during the trial picking operation. Accordingly, apporopriate picking conditions are determined for each type of weft yarn for multiple weft weaving operation.

Consequently, according to the present invention, the variation of the actual weft yarn arrival crankshaft angle corresponding to the variation of the pressure of the picking fluid or the picking fluid jetting timing is measured during the trial picking operation, and then appropriate picking conditions for the target weft yarn arrival crankshaft angle are determined automatically on the basis of the measured data. Accordingly, when the loom is set for new weaving conditions or when the weaving conditions are changed, optimum picking conditions are established rapidly before starting the normal weaving operation.

Since the optimum picking conditions are established beforehand during the trial picking operation, the variation of the controlled values is small when the weft yarn arrival crankshaft angle is regulated automatically during the operation of the loom. Therefore, transient unstable operation at the initial stage of operation following the start of operation is avoided and the ranges of control of the controlled values are narrowed, and thereby the highly accurate automatic control of the weft yarn arrival crankshaft is achieved.

It is another object of the present invention to provide a method and a device capable of automatically and periodically regulating the pressure of the picking fluid and picking fluid jetting start timing to make the actual weft yarn arrival crankshaft angle coincide with the target weft yarn arrival crankshaft angle so that the change of the weaving conditions of a plurality of looms for multi-product small-scale production are dealt with quickly to stabilize the picking operation in the following weaving operation in order to stabilize the quality of the woven fabrics.

Accordingly, according to the present invention, the pressure of the picking fluid and the picking fluid jetting start timing are varied sequentially within a range which will not affect the weaving operation when the actual weft yarn arrival crankshaft angle varies beyond a predetermined range, actual weft yarn arrival crankshaft angles corresponding to the new picking conditions are measured, then the relation between the actual weft yarn arrival crankshaft angles and the new picking conditions is determined, and then a new picking condition, namely, a pressure of the picking fluid or a picking fluid jetting start crankshaft angle corresponding to the target weft yarn arrival crankshaft angle is obtained through calculation. Thereafter, the picking nozzle is operated according to the new picking condition.

Such a mode of control operation is able to deal with the variation of the actual weft yarn arrival crankshaft angle attributable to the specific characteristics of the loom, the variation of the external conditions and the variation of the physical properties of the weft yarn.

Thus, according to the present invention, at least the pressure of the picking fluid or the picking fluid jetting start crankshaft angle can be positively varied within a range which will not substantially affect the weaving operation, while the loom is operating, and the actual weft yarn arrival crankshaft angle is adjusted automatically to the target weft yarn arrival crankshaft angle. Accordingly, the respective picking conditions of a plurality of looms can properly be regulated according to the individual specific characteristics of the looms, and the picking conditions are regulated quickly and properly even if the external conditions and/or the physical properties of the weft yarn vary during the weaving operation of the loom.

DESCRIPTION OF THE PREFERRED EMBODIMENT

Figure 1:
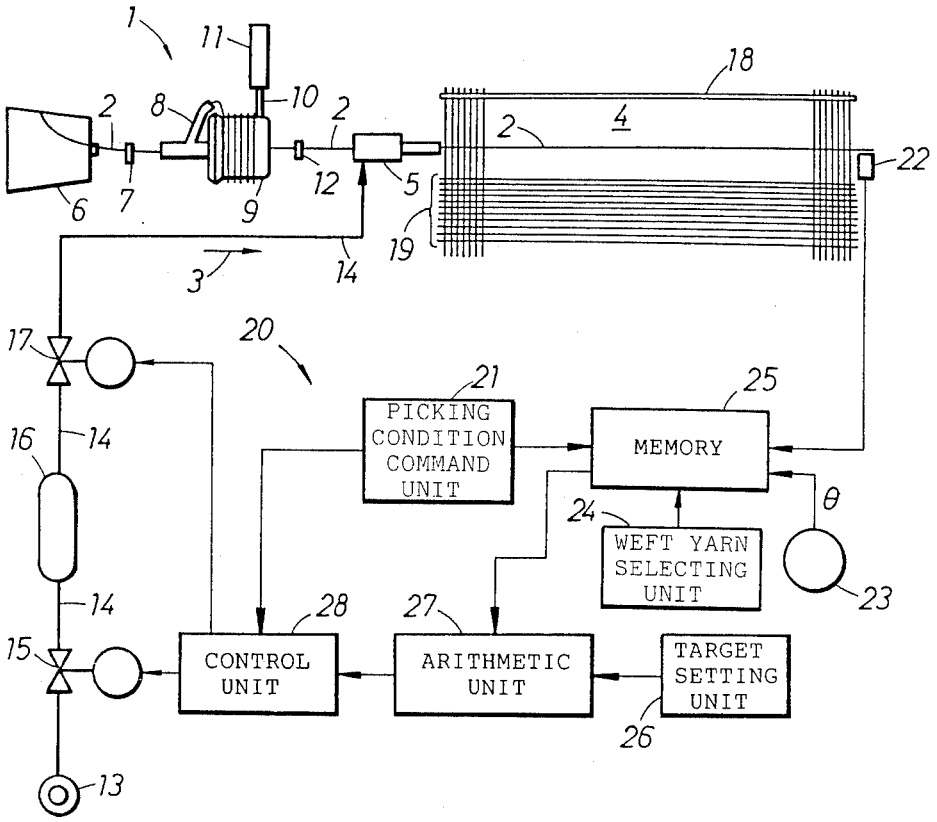
FIG. 1 is a block diagram showing the constitution of an automatic picking conditions regulating device, in a first embodiment, according to the present invention as illustrated in association with a picking device.

First Embodiment (FIGS. 1, 2, and 3):

Referring to FIG. 1, a picking device 1 has a picking nozzle 5 for picking a weft yarn 2 into a shed 4 by means of a pressurized picking fluid 3. The weft yarn 2 is unwound from a yarn package 6 and is drawn via a balloon guide 7 into a rotary yarn guide 8. The rotary yarn guide 8 rotates around a measuring and storing drum 9 to wind a predetermined length of the weft yarn 2 on the measuring and storing drum 9. The weft yarn 2 thus wound on the measuring and storing drum 9 is reserved for picking. While the weft yarn 2 is being measured and wound on the drum 9, the free end of the weft yarn 2 is retained on the circumference of the drum 9 with a retaining pin 10. The retaining pin 10 is retracted by an actuator 11 at the moment of start of the picking operation to release the weft yarn 2 stored on the drum 9 so that the weft yarn 2 can be picked through a yarn guide 12 into the shed 4 with the picking nozzle 5. On the other hand, the picking fluid 3 is supplied from a fluid source 13 through an accumulator tank 16 and a shutoff valve 17 to the picking nozzle 5. The weft yarn 2 is picked into the shed 4 together with the picking fluid 3 by the picking nozzle 5, and then the picked weft yarn is beaten with the reed 18 to produce a fabric 19.

An automatic picking conditions regulating device 20 according to the present invention comprises a picking condition command unit 21, a weft yarn arrival detector 22, a crankshaft angle detector 23, a weft yarn selecting unit 24, a memory 25, a target setting unit 26, an arithmetic unit 27, and a control unit 28. The respective outputs of the picking condition command unit 21, the weft yarn arrival detector 22, the crankshaft angle detector 23 and the weft yarn selecting unit 24 are connected to the input of the memory 25. The respective outputs of the memory 25 and the target setting unit 26 are connected to the inputs of the arithmetic unit 27. The input and the output of the control unit 28 are connected to the arithmetic unit 27 and the picking condition command unit 21, and to a pressure control valve 15 provided in a line 14 for supplying the picking fluid to the picking nozzle 5, respectively. The control unit 28 is connected also to the shutoff valve 17.

During a trial picking operation, the picking condition command unit 21 gives an output signal for every full rotation of the crankshaft to the control unit 28 to change the pressure of the picking fluid 3 sequentially to P1, P2, . . . and Pn within a predetermined range. Then, the control unit 28 controls the pressure control valve 15 proportionally to the input signals to change the pressure of the picking fluid 3 sequentially. The control unit 28 also controls the opening crankshaft angle $\theta o$ and the closing crankshaft angle $\theta c$ of the shutoff valve 17 in synchronism with the rotation of the crankshaft of the loom. In this embodiment, the crankshaft angles $\theta o$ and $\theta c$ are fixed.

Thus, the picking nozzle 5 jets the picking fluid 3 at different pressures p1, p2, . . . and pn for successive picking cycles, respectively, to pick the weft yarns 2 into the shed 4.

Figure 2:
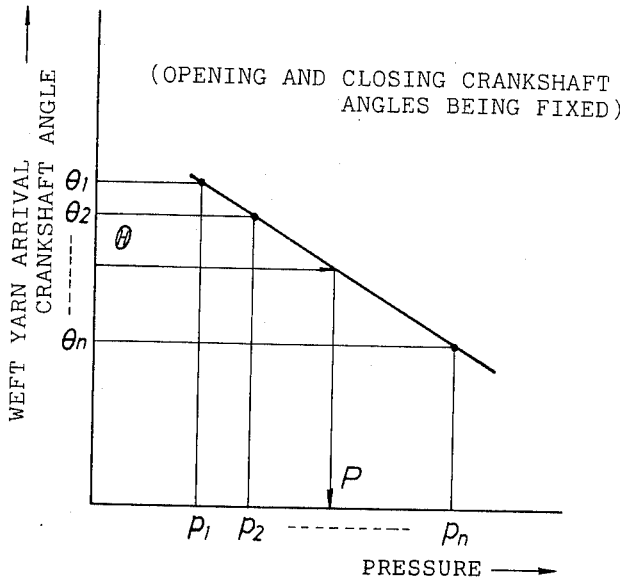
FIG. 2 is a graph showing the variation of the weft yarn arrival crankshaft angle with the pressure of the picking fluid.

On the other hand, the weft yarn arrival detector 22 disposed at a predetermined position, for example, at a position corresponding to the edge of the fabric on the weft yarn receiving side of the loom, detects actual weft yarn arrival crankshaft angles $\theta 1$, $\theta 2$, . . . and $\theta n$ during the trial picking operation. During the trial picking operation, the output signals provided by the picking condition command unit 21 to produce the pressures p1, p2, . . . and pn, and the corresponding actual weft yarn arrival crankshaft angles $\theta 1$, $\theta 2$, . . . and $\theta n$, are stored sequentially in the memory 25. When the loom is of the multiple weft type, the memory 25 sorts the output signals corresponding to the pressures Pi (i=1 to n) and the actual weft yarn arrival crankshaft angles $\theta i$ (i=1 to n) on the basis of selection signals provided by the weft yarn selection command unit 24 by the type of the weft yarn, and stores the data for the different types of weft yarns sequentially at predetermined different addresses assigned to the different types of weft yarns, respectively. The number of trial picking cycles is dependent on the required control accuracy. FIG. 2 is an exemplary graph showing the variation of the actual weft yarn arrival crankshaft angle $\theta i$ with the pressure Pi of the picking fluid, in which the actual weft yarn arrival crankshaft angle varies in inverse proportion to the pressure of the picking fluid as represented by a straight line in FIG. 2.

A target weft yarn arrival crankshaft angle $\theta$ is given beforehand to the target setting unit 26. After the trial picking operation has been completed, the arithmetic unit 27 executes the direct operation or the interpolatory operation of the actual weft yarn arrival crankshaft angles $\theta i$ obtained through the trial picking operation and the pressures pi of the picking fluid to obtain a pressure corresponding to the target weft yarn arrival crankshaft angle $\theta$, and gives a signal corresponding to the pressure P to the control unit 28. Then, the control unit 28 controls the pressure control valve 15 on the basis of the signal corresponding to the pressure P to adjust the pressure of the picking fluid 3 automatically to the target pressure P. At this stage, the picking condition command unit 21 is at rest.

Thus the pressure of the picking fluid 3 is set automatically prior to the practical weaving operation. Accordingly, the picking device 1 performs the normal picking operation using the picking fluid 3 of the target pressure P.

In the first embodiment, during the trial picking the pressure of the picking fluid is changed every picking cycle and the corresponding actual weft yarn arrival crankshaft angle is stored in the memory 25. However, the relation between the pressure of the picking fluid and the actual weft yarn arrival crankshaft angle can be determined more accurately by changing the pressure of the picking fluid every several picking cycles and storing the average of the actual weft yarn arrival crankshaft angles for each pressure.

In the first embodiment, the pressure of the picking fluid 3 is the only controlled value, however, the jet starting crankshaft angle and the jet ending crankshaft angle of the picking nozzle 5 may be employed as the controlled values, and hence the control object of the control unit 28 may be the shutoff valve 17.

Figure 3:
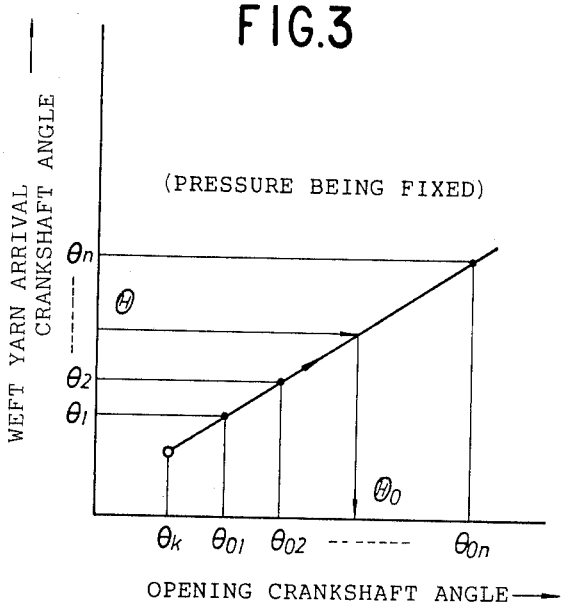
FIG. 3 is a graph showing the variation of the weft yarn arrival crankshaft angle with the picking fluid jetting start crankshaft angle.

FIG. 3 is a graph showing the variation of the actual weft yarn arrival crankshaft angle $\theta i$ with the shutoff valve opening crankshaft angle $\theta oi$, in which the target weft yarn arrival crankshaft angle $\theta$ and an optimum shutoff valve opening crankshaft angle $\theta o$ are indicated, and the period of opening of the shutoff valve 17 is fixed for the sake of convenience.

As apparent from the foregoing description, the pressure of the picking fluid 3 is not only possible controlled value; the jet starting crankshaft angle and the jet ending crankshaft angle, or a combination of the pressure of the picking fluid, the jet starting crankshaft angle, and the jet ending crankshaft angle may be the controlled value.

The applicant of the present application proposed a control method effective for controlling the actual weft yarn arrival crankshaft angle by regulating the jet starting and ending crankshaft angles and the pressure of the picking fluid 3 in combination in Japanese Patent Application No. 60-226,449. According to this control method, either the pressure of the picking fluid or the jet starting and ending crankshaft angles is regulated selectively, or the pressure of the picking fluid and the jet starting and ending crankshaft angles are regulated simultaneously depending on the variation of the diameter of the yarn package 6.

Although the automatic picking conditions regulating device 20 according to the present invention is illustrated as an aggregate of functional units for convenience's sake, these functional units may be the integral components of a computer or the softwear for a computer.

Second Embodiment (FIGS. 4, 5):

An automatic picking conditions regulating device 20 in a second embodiment of the present invention is provided with the following components in addition to those of the first embodiment, to control the weft yarn arrival crankshaft angle automatically also during the weaving operation of the loom.

Figure 4:
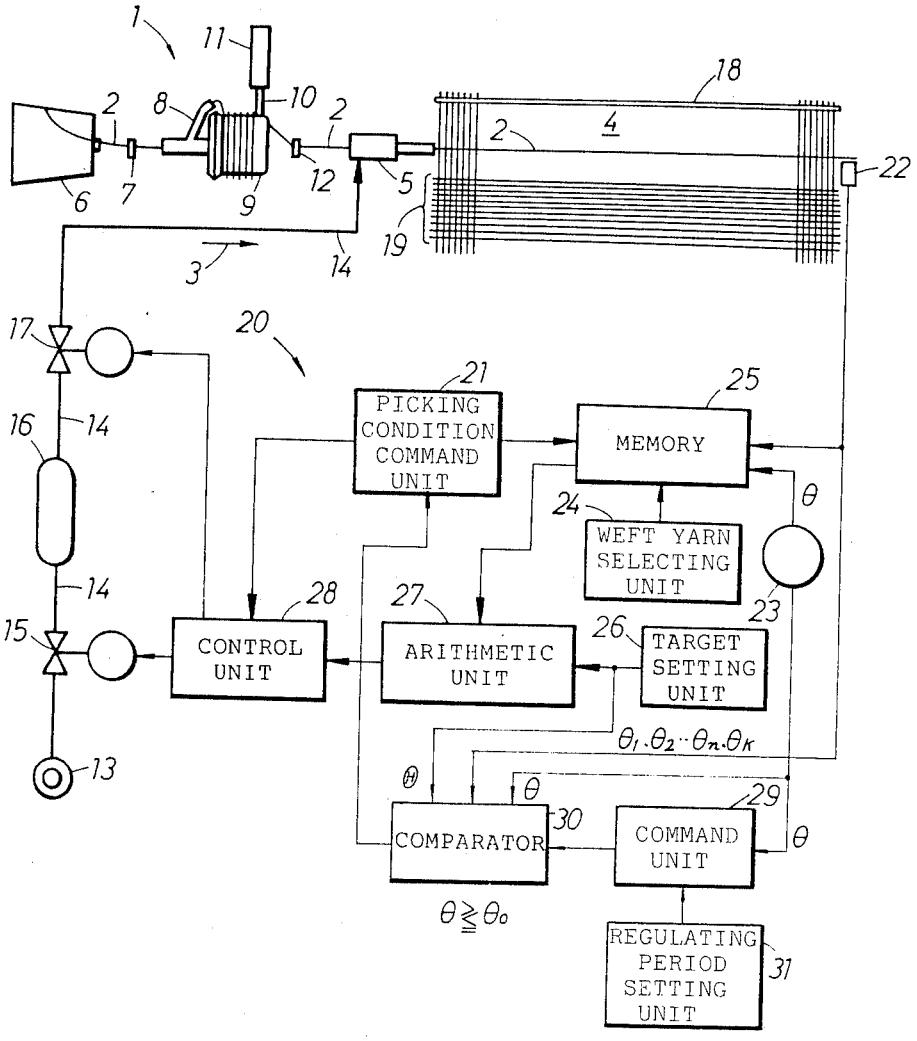
FIG. 4 is a block diagram showing the constitution of an automatic picking conditions regulating device, in a second embodiment, according to the present invention as illustrated in association with a picking device.
Figure 5:
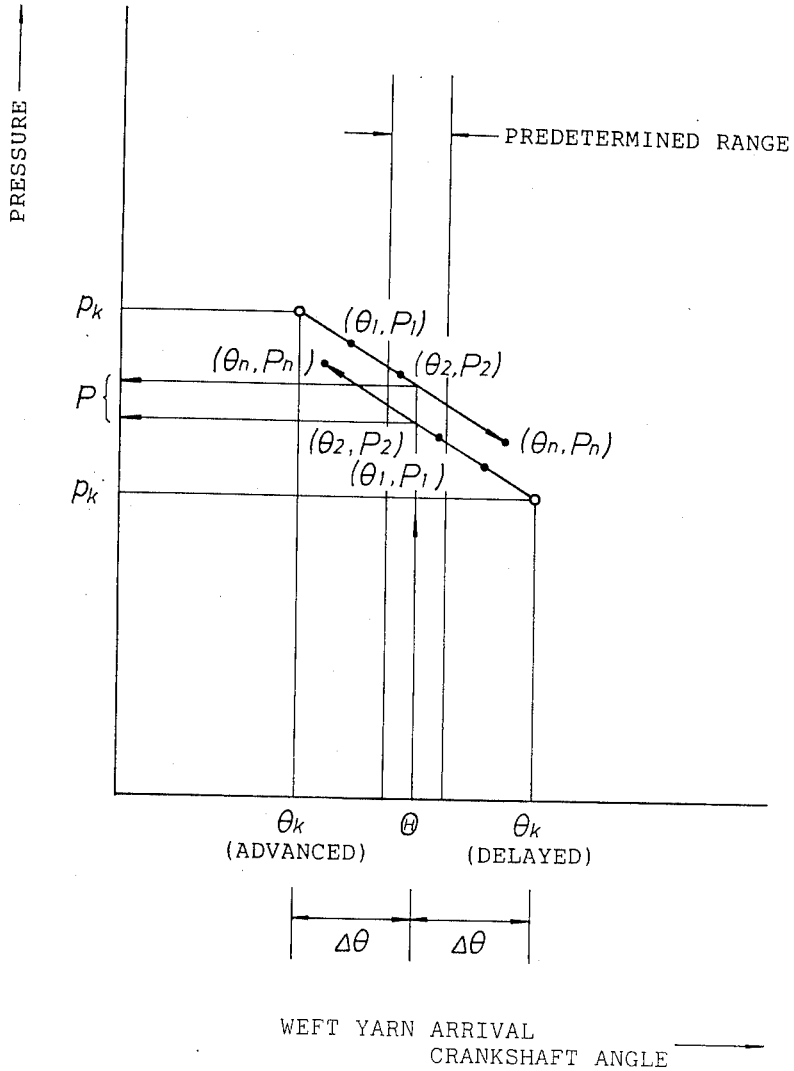
FIG. 5 is a graph showing the variation of the weft yarn arrival crankshaft angle with the pressure of the picking fluid during a weaving operation.

Referring to FIG. 4, the second embodiment comprises the components of the first embodiment, and also a command unit 29, such as a counter, a comparator 30, and a regulating period setting unit 31. The crankshaft angle detector 23 is connected also to the respective inputs of the command unit 29 and the comparator 30. The weft yarn arrival detector 22 and the target setting unit 26 are connected to the other input of the comparator 30. The command unit 29 has an input connected to the regulating period setting unit 31 and an output connected to the comparator 30. The comparator 30 compares the actual weft yarn arrival crankshaft angle $\theta k$ and the target weft yarn arrival crankshaft angle $\theta$ every predetermined angle $\theta$ of rotation of the crankshaft, and then gives a signal corresponding to the difference between the target weft yarn arrival crankshaft angle $\theta$ and the actual weft yarn arrival crankshaft angle $\theta k$ to the picking condition command unit 21.

A series of the same control operations as those of the first embodiment are executed for a trial picking operation to determine the pressure of the picking fluid 3 automatically prior to starting the practical weaving operation. Accordingly, the picking device 1 jets the picking fluid 3 at the target pressure P for the normal picking operation.

During the weaving operation of the loom, the automatic picking conditions regulating device 20 performs the picking conditions regulating operation periodically. The command unit 29 gives a command signal periodically, namely, every predetermined number of picks or every predetermined time, to the comparator 30 after the loom has been started. Upon the reception of the command signal, the comparator 30 compares the present actual weft yarn arrival crankshaft angle $\theta k$ and the target weft yarn arrival crankshaft angle $\theta$, and then gives a signal representing the result of the comparison to the picking condition command unit 21. When the actual weft yarn arrival crank shaft angle $\theta k$ is equal to the target weft yarn arrival crankshaft angle $\theta$ or is within a predetermined control range, no particular control operation is necessary and hence the picking condition command unit 21 maintains the present picking conditions. When the actual weft yarn arrival crankshaft angle $\theta k$ is delayed excessively with reference to the target weft yarn arrival crankshaft angle $\theta$, the pressure of the picking fluid 3 needs to be raised. On the contrary, when the actual weft yarn arrival crankshaft angle $\theta k$ is advanced excessively with reference to the target weft yarn arrival crankshaft angle $\theta$, the pressure of the picking fluid 3 is lowered. Thus, the comparator 30 gives an appropriate signal to the picking condition command unit 21 on the basis of the result of the comparison. Upon the reception of the signal from the comparator 30, the picking condition command unit 21 actuates the control unit 28 so that the present actual weft yarn arrival crankshaft angle $\theta k$ is advanced or delayed sequentially within a range which will not significantly affect to the weaving operation by a predetermined increment or a predetermined decrement at a time. As obvious from the foregoing description, when the actual weft yarn arrival crankshaft angle $\theta k$ is delayed with reference to the target weft yarn arrival crankshaft angle $\theta$, the pressure of the picking fluid 3 is raised sequentially to pn, pn-1, . . . p2, and p1. On the contrary, when the actual weft yarn arrival crankshaft angle $\theta k$ is advanced with reference to the target weft yarn arrival crankshaft angle $\theta$, the pressure of the picking fluid 3 is lowered sequentially to p1, p2, . . . and pn. While the pressure of the picking fluid 3 is being changed sequentially, the memory 25 receives signals representing the pressures p1, p2, . . . and pn from the picking condition command unit 21, and receives signals representing the corresponding actual weft yarn arrival crankshaft angles $\theta 1$, $\theta 2$, . . . $\theta n$ from the weft yarn arrival detector 22, and then stores the respective combinations of the pressure signals and the corresponding weft yarn arrival crankshaft angle signals as indicated by ($\theta 1$, P1), ($\theta 2$, P2), . . . and ($\theta n$, Pn) in FIG. 5. As mentioned above, when the loom is of the multiple weft type, a weft yarn selection command unit, not shown, controls the memory 25 so that the pressures Pk and the actual weft yarn arrival crankshaft angles $\theta k$ for each weft yarn are stored at a specific address.

After the pressure of the picking fluid 3 has been changed sequentially to p1, p2, . . . and pn within a range which will not significantly affect the weaving operation of the loom, the arithmetic unit 27 determines the correlation between the pressure Pn and the actual weft yarn arrival crankshaft angle $\theta k$ from the data stored in the memory 25 to obtain a new pressure P corresponding to the target weft yarn arrival crankshaft angle $\theta$, and then gives a signal representing the pressure P to the control unit 28. Thus, the pressure of the picking fluid 3 is regulated properly according to the actual weaving conditions.

The period of regulation is determined so that the weft yarn arrival crankshaft angle will be readjusted before the variation $\Delta\theta$ of the weft yarn arrival crankshaft angle increases execessively requiring the adjustment of the pressure P of the picking fluid beyond the range corresponding to the target weft yarn arrival crankshaft angle $\theta$. Such a mode of determination of the period of regulation is effective when the variation $\Delta\theta$ of the weft yarn arrival crankshaft angle increases with the variation of the diameter of the yarn package 6 as the weaving operation progresses.

In the second embodiment, the present pressure Pk of the picking fluid is raised or lowered on the basis of the result of comparison of the target weft yarn arrival crankshaft angle $\theta$ and the actual weft yarn arrival crnakshaft angle $\theta k$. However, the pressure P corresponding to the target weft yarn arrival crankshaft angle $\theta$ may be calculated on the basis of the correlation between the pressures Pi and the corresponding actual weft yarn arrival crankshaft angles $\theta i$ after raising or lowering the pressure of the picking fluid. In such a case, the required pressure P is expected to deviate from the finite line determined through calculation, so that this mode of regulation is inferior to the former mode of regulation in accuracy.

In the second embodiment, the correlation between the pressure of the picking fluid and the weft yarn arrival crankshaft angle is represented by a straight line. However, when the correlation is represented by a curved line due to conditions defining the correlation, such as the type of the weft yarn and weaving conditions, the correlation may be determined on the basis of measured values through calculation. Furthermore, although the pressure of the picking fluid is changed every picking cycle and the corresponding actual weft yarn arrival crankshaft angles $\theta 1$, $\theta 2$, . . . and $\theta n$ are stored in the memory to determine the correlation between the pressure of the picking fluid and the weft yarn arrival crankshaft angle, the correlation can be determined more accurately by changing the pressure of the picking fluid every predetermined number of picking cycles and by storing the average actual weft yarn arrival crankshaft angles $\theta 1$, $\theta 2$, . . . and $\theta n$ corresponding to each pressure of the picking fluid.

In the second embodiment, the pressure of the picking fluid 3 is the only controlled value, however, as mentioned above, the controlled value may be the jet starting crankshaft angle of the nozzle, and hence the object of control of the control unit 28 may be the shut-off valve 17.

Furthermore, although the second embodiment executes the control operation after a predetermined number of picking cycles, the control operation may be executed when the actual weft yarn arrival crankshaft angle varies beyond a predetermined range around the target weft yarn arrival crankshaft angle on the basis of decision made by the command unit 29.

Although the invention has been described in its preferred forms with a certain degree of particularity, it is to be understood that many variations and changes are possible in the invention without departing from the scope thereof.

What is claimed is:

1. A method for automatically regulating a picking condition of a loom which has a crankshaft and which picks a weft yarn into a shed using a jet of fluid from a picking nozzle, comprising the steps of:

setting the picking condition to a plurality of predetermined values during respective picking operations;

detecting for each of said picking operations the crankshaft angle at which the picked weft yarn arrives at a predetermined location in the shed;

storing each predetermined value of the picking condition and the corresponding detected weft yarn arrival crankshaft angle;

determining a target weft yarn arrival crankshaft angle at which a picked weft yarn is to arrive at the predetermined location in a normal weaving operation;

calculating an appropriate value of the picking condition corresponding to the target weft yarn arrival crankshaft angle on the basis of the correlation between the predetermined values of the picking condition and the detected weft yarn arrival crankshaft angles which have been stored; and thereafter controlling the picking condition to be the calculated value of the picking condition.

2. A method according to claim 1, including the step of selecting as the picking condition one of the pressure of the jet of fluid, the crankshaft angle at which the jet of fluid is started, and the crankshaft angle at which the jet of fluid is stopped.

3. A method according to claim 1, including the steps of using different types of weft yarn, and classifying the detected weft yarn arrival crankshaft angles according to the type of weft yarn when carrying out said storing step.

4. An apparatus which automatically regulates a picking condition of a loom which has a crankshaft and which picks a weft yarn into a shed using a jet of picking fluid from a picking nozzle, comprising:

command means for sequentially providing a plurality of predetermined values of the picking condition;

control means for varying the supply of the picking fluid from a fluid source to the picking nozzle according to the different predetermined values of the picking condition provided by the command means;

weft yarn arrival detector means for detecting the crankshaft angle at which a picked weft yarn arrives at a predetermined location in the shed;

memory means for storing the predetermined values of the picking condition provided by the command means and the corresponding weft yarn arrival crankshaft angles detected by the weft yarn arrival detector means;

target setting means for specifiying a target weft yarn arrival crankshaft angle appropriate for a normal weaving operation; and arithmetic means for calculating an appropriate value of the picking condition corresponding to the target weft yarn arrival crankshaft angle specified by the target setting means on the basis of the correlation between the detected weft yarn arrival crankshaft angles stored in the memory means and the predetermined values of the picking condition stored in the memory means, and for providing the calculated value of the picking condition to the control means, the control means thereafter controlling the supply of the picking fluid to the picking nozzle in accord with the calculated value of the picking condition.

5. An apparatus according to claim 4, wherein said control means controls a pressure control valve interposed between the fluid source and the picking nozzle.

6. An apparatus according to claim 4, wherein said control means controls the points in time at which a shutoff valve interposed between the fluid source and the picking nozzle is opened and closed.

7. An apparatus according to claim 4, including a weft yarn selection command unit which produces a yarn selection signal indicating which of several types of weft yarn is to be inserted in each picking operation, and wherein said memory means stores each predetermined value of the picking condition and the associated detected weft yarn arrival crankshaft angle in a respective classification corresponding to the respective type of weft yarn on the basis of the weft yarn selection signal from the weft yarn selection command unit.

8. An apparatus for automatically regulating a picking condition of a loom which has a crankshaft and which picks a weft yarn into a shed using a jet of picking fluid from a picking nozzle, comprising:

weft yarn arrival detector means for detecting the crankshaft angle at which each picked weft yarn arrives at a predetermined location in the shed;

command signal means for providing a command signal at predetermined intervals during weaving;

picking condition command means for providing, following one occurrence of said command signal from the command signal means, a plurality of signals defining a progressive change of the value of the picking condition over several picking operations by successive predetermined change amounts so that the picking condition is varied within a range which has a negligible effect on a fabric woven by the loom;

memory means for storing the values of the picking condition used during said progressive change thereof and for storing the corresponding detected weft yarn arrival crankshaft angles;

arithmetic means for determining a correlation between the stored values of the picking condition and the stored weft yarn arrival crankshaft angles, and for calculating an appropriate value of the picking condition on the basis of the correlation; and control means for controlling, after said one occurrence of said command signal, the supply of the picking fluid from a fluid source to the picking nozzle first on the basis of the plurality of signals from the picking condition command means and thereafter on the basis of the calculated value from the arithmetic means.

9. An apparatus according to claim 8, wherein said control means controls a pressure control valve interposed between the fluid source and the picking nozzle.

10. An apparatus according to claim 8, wherein said control means controls the points in time at which a shutoff valve interposed between the fluid source and the picking nozzle is opened and closed.

11. An apparatus according to claim 8, including a weft yarn selection command unit which produces a yarn selection signal indicating which of several types of weft yarn is to be inserted in each picking operation, and wherein said memory means stores each said value of the picking condition during said progressive change thereof and the associated detected weft yarn arrival crankshaft angle in a respective classification corresponding to the weft yarn selection signal from the weft yarn selection command unit.

12. An apparatus according to claim 8, wherein each said predetermined interval is a predetermined number of picking operations.

13. An apparatus according to claim 8, wherein each said predetermined interval is a predetermined period of time.

* * * * *